US005575228A

United States Patent [19]

Padgett, III et al.

[11] Patent Number: 5,575,228

[45] Date of Patent: Nov. 19, 1996

[54] VARIABLE GAUGE TUFTING APPARATUS

[75] Inventors: W. Paul Padgett, III, Rome, Ga.; Brian K. Lovelady, Soddy-Daisy, Tenn.

[73] Assignee: Tuftco, Inc., Chattanooga, Tenn.

[21] Appl. No.: 112,662

[22] Filed: Aug. 25, 1993

[51] Int. Cl.[6] ..... D05C 15/12; D05C 15/30

[52] U.S. Cl. ..... 112/80.41; 112/80.01

[58] Field of Search ..... 112/80.41, 80.4, 112/80.55, 80.01, 266.2

[56] References Cited

U.S. PATENT DOCUMENTS

| | | | |
|---|---|---|---|
| 3,401,657 | 9/1968 | Watkins . | |
| 3,421,929 | 1/1969 | Watkins . | |
| 3,428,007 | 2/1969 | Wignall et al. . | |
| 3,601,071 | 8/1971 | Watkins et al. . | |
| 3,677,206 | 7/1972 | MacIsaac et al. . | |
| 3,722,442 | 3/1973 | MacIsaac, Jr. et al. | 112/266.2 X |
| 4,103,630 | 8/1978 | Wignall | 112/80.4 X |
| 4,366,761 | 1/1983 | Card | 112/80.41 |
| 4,800,828 | 1/1989 | Watkins | 112/80.41 |

FOREIGN PATENT DOCUMENTS

| | | |
|---|---|---|
| 962594 | 7/1964 | United Kingdom . |
| 1098568 | 1/1968 | United Kingdom . |
| 1100170 | 1/1968 | United Kingdom . |
| 1098219 | 1/1968 | United Kingdom . |
| 1177646 | 1/1970 | United Kingdom . |
| 1375215 | 11/1974 | United Kingdom . |
| 1558461 | 1/1980 | United Kingdom . |
| WO84/00388 | 2/1984 | WIPO . |

*Primary Examiner*—Clifford D. Crowder
*Assistant Examiner*—Paul C. Lewis
*Attorney, Agent, or Firm*—Douglas T. Johnson

[57] ABSTRACT

A single or multiple needle bar tufting machine is provided with loop forming fingers above the substrate or base fabric and by laterally shifting the needles during tufting, rows of loop stitches are formed over the loop forming fingers on the face of the substrate and rows of pile loops are formed on the back side. Methods are disclosed for utilizing this machine in connection with yarn feed pattern control devices, pattern control needle bar positioners, a controllable fabric feed, to create a variety of novel fabrics and fabrics simulating patterns heretofore only made on looms and knitting machines. The resulting fabrics offer many advantages including lower stitch rates, better substrate coverage, less resistance to sliding traffic, increased abrasion resistance, and improved draping characteristics.

17 Claims, 9 Drawing Sheets

VARIABLE GAUGE TUFTING APPARATUS

The invention relates to a tufting apparatus and process that forms the face of the carpet on the top side of the primary backing material or substrate and the method of operating the tufting apparatus.

In a tufting machine, the face of the carpet is generally formed by loopers operating beneath the substrate. The top side of the substrate shows only the backstitch. In these tufting machines, one or more rows of yarn carrying needles are reciprocally driven through the substrate being fed through the machine across a bed plate to form loops that are seized by loopers oscillating below the substrate and bed plate in timed relationship with the needles. Numerous modifications have been made to such tufting machines in order to create a variety of fabric textures and designs. For instance, to change the depth of the pile height produced by a tufting machine various methods have been devised to change the length of the stroke of the needles, and the elevation of the bed plate relative to the loopers as in U.S. Pat. Nos. 2,977,905 and 3,332,379. It is also possible to add a knife block to operate in cooperation with the loopers to produce cut pile rather than looped pile fabric as in U.S. Pat. Nos. 3,277,852 and 4,445,446 or even a combination of cut pile and loop pile as in U.S. Pat. Nos. 3,019,748 or 3,084,645. In order to produce patterned fabric various techniques have been devised to laterally move or "shog" the needle bar or substrate as in U.S. Pat. Nos. 3,393,654 and 4,173,192. In addition, a variety of yarn feeding devices have been developed to allow the creation of even more complicated patterns by back-robbing selected yarns so that the resulting loops are very low to the substrate and are "buried" by other higher adjacent loops, as in U.S. Pat. Nos. 2,862,465 and 3,103,187.

There is constant development of modified tufting equipment in an attempt to produce novel carpet designs. It is also desirable that carpet designs make efficient use of yarn so that a relatively high proportion of the yarn used is on the face of the carpet. Although it is necessary that some yarn appear on the back side of the substrate so that a strong tuft bond can be created by applying a latex backing or other adhesive to encapsulate the carpet fibers on the back side, the carpet industry has resisted placing additional yarn on the back side even if the resulting pattern is desirable.

The tufting industry is progressively evolving through innovation directed toward duplicating, or at least simulating, products which previously were only produced by weaving on a loom or on knitting machines. The evolution of such tufted products, combined with the substantially higher production rates of the tufting process relative to weaving has resulted in more universal availability of tufted products that resemble wovens. The present invention, denominated a "variable gauge tufting machine," provides the ability to produce novel variable gauge fabrics with an appearance that could only heretofore be produced by looms or knitting machines, as well as fabrics that have not heretofore been produced. Furthermore, the variable gauge tufting machine can produce these fabrics while leaving a relatively minimal amount of yarn on the back of the carpet.

Substantial advantages are achieved in fabrics manufactured with frequent shifting of the needle bar or bars. In such fabrics, the variable gauge tufting machine can achieve the same coverage of substrate with lower stitch rates than conventional tufting machines and less adhesive is generally required to encapsulate the carpet fibers on the back side of the substrate. An additional advantage is that during the manufacturing process, the face of the fabric is visible to the tufting machine operator so that defects are more quickly detected allowing correction of any problems with less wasted product and production time. Furthermore, the resulting fabrics are less resistant to sliding traffic, have increased abrasion resistance, and have a greater tendency to lie flat than ordinary tufted fabrics.

The fabrics manufactured according to the present invention, which are claimed in our copending application entitled Variable Gauge Fabrics and Method of Manufacture, have a wide range of applications, from carpet for floor covering and automotive uses, to wall coverings, upholstery and filters.

SUMMARY OF THE INVENTION

It is therefore an object of this invention to provide a method and apparatus for forming tufted fabrics in which the face of the fabric is in the form of transverse or diagonally transverse loop stitches or straight stitches and the backstitching consists of loop or cut pile tufts.

It is also an object of this invention to provide an apparatus to produce novel tufted fabrics which by the use of transverse or diagonally transverse loop stitches or straight stitches have the appearance of fabrics that could only heretofore be produced on looms or knitting machines, and other fabrics which have never heretofore been produced.

A tufting machine made in accordance with this invention has an additional "loop forming plate" mounted above the substrate with loop forming fingers extending rearward in the direction of the fabric feed. Transverse or diagonally transverse loop stitches are formed on the top surface of the substrate over the loop forming fingers by laterally shifting the needle bar relative to the substrate, after the needles' penetration of and retraction from the substrate. Fabrics with simple patterns involving only varying the gauge or lateral length of the loop stitches may be created by a tufting machine with a single needle bar, while more complex patterns may be created by a tufting machine with multiple needle bars.

A tufting machine incorporating the present invention with independently shiftable dual needle bars makes it possible to produce patterns in tufted fabric which have the appearance of patterns only heretofore produced on looms or knitting machines.

It is also possible to overtuft existing carpets and other fabrics utilizing the present invention to create patterns or an embroidered appearance.

It is a further object of the invention to allow the manufacture of more easily moldable carpet to be mounted on contoured surfaces such as automobile floorboards.

It is yet another object of the invention to allow the manufacture of fabrics which have the appearance of course fabrics on a fine gauge machine, through the use of relatively long laterally shifted stitches. By increasing the stitch rate, the appearance created by small yarns can be made to simulate the usual visual appearance of larger yarns.

It is another object of the invention to allow the manufacture of fabrics with unique textures by varying yarn densities across the face of the fabric by stitch rate and by the length of the laterally shifted stitches.

Although the preferred shift drive actuator for shifting the needle bar or bars is an electrohydraulic needle bar positioning apparatus, such as that described in U.S. Pat. No. 4,173,192, it is possible to shift a needle bar or bars with conventional mechanical shift actuators such as those incorporating pattern cams.

Other objectives and advantages of the invention will be best understood when reading the following detailed description with the accompanying drawings.

DESCRIPTION OF THE PREFERRED EMBODIMENT

Figure 1:
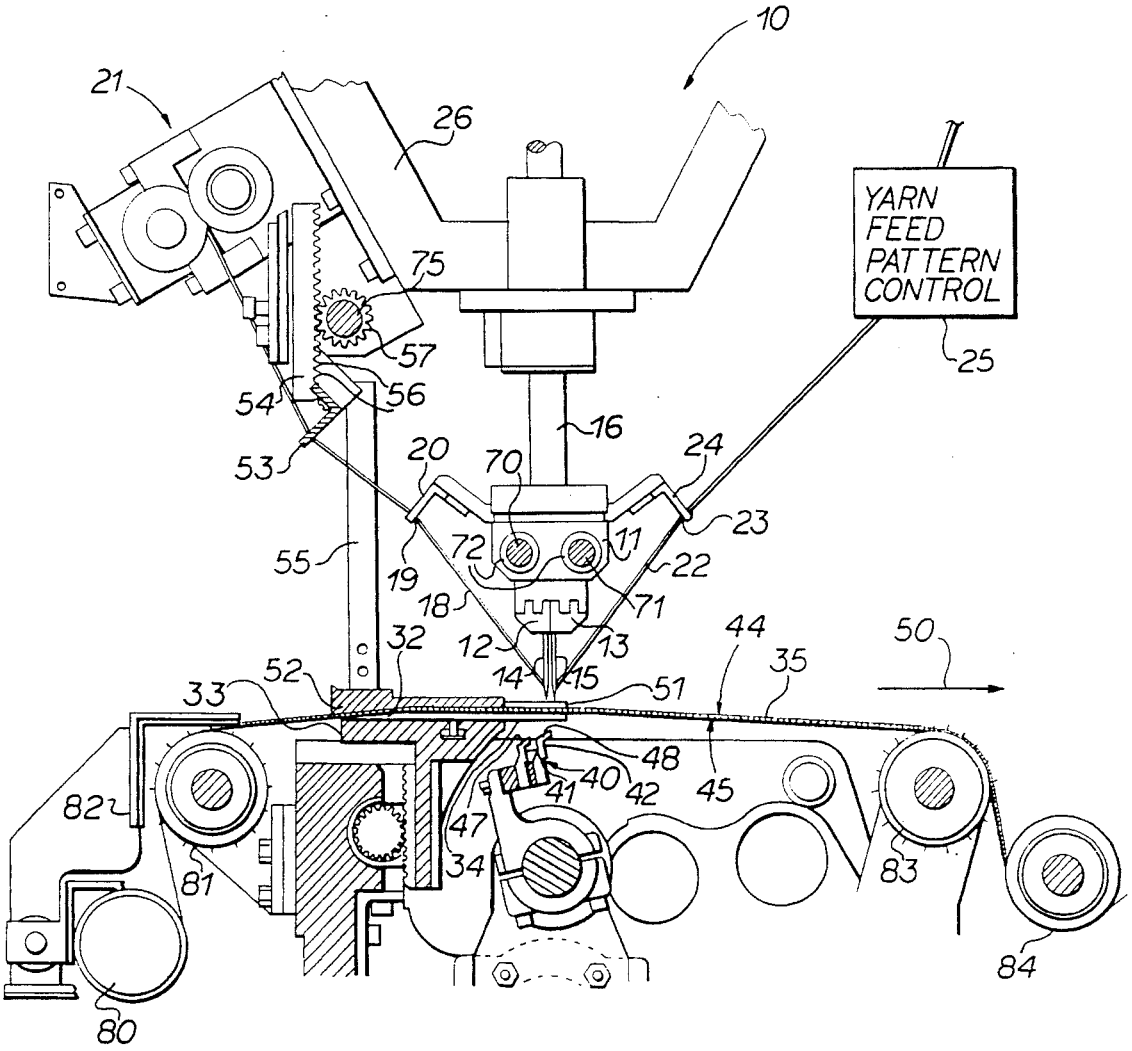
FIG. 1 is a sectional side view of a multiple needle bar tufting machine according to the present invention.

FIG. 1 discloses a loop pile tufting machine 10 including a plurality of elongated transversely spaced needle bar carriers 11 supporting a front needle bar 12 and a rear needle bar 13. The front needle bar 12 supports a row of transversely spaced front needles 14, while the rear needle bar 13 supports a row of transversely spaced rear needles 15. Each needle bar carrier 11 is connected to a push rod 16 adapted to be vertically reciprocated by a conventional needle drive mechanism, not shown.

Front yarns 18 are supplied to the corresponding front needles 14 through corresponding apertures 19 in the front yarn guide plate 20 from a source of yarn supply, not shown, such as yarn feed rolls, creels, or other known yarn supply means. Preferably, the front yarns 18 pass through a yarn feed pattern control mechanism 21, adapted to feed the appropriate length of individual front yarns 18 to corresponding front needles 14 in accordance with a predetermined pattern. Any one of several pattern control mechanisms may be incorporated in the mechanism 21, such as those disclosed in U.S. Pat. Nos. 2,782,905 and 2,935,037.

In the same manner, rear yarns 22 are supplied to the corresponding rear needles 15 through corresponding apertures 23 in the rear yarn guideplate 24 from another source of supply for the yarns, not shown. In a preferred form of the invention, the rear yarns 22 are fed through a separate yarn feed pattern control mechanism 25 which may be independent of the front yarn feed pattern control mechanism 21 in order to permit the appropriate length of individual rear yarns 22 to be fed to corresponding rear needles 15, depending upon the predetermined pattern incorporated in the rear pattern control mechanism 25.

Figure 2:
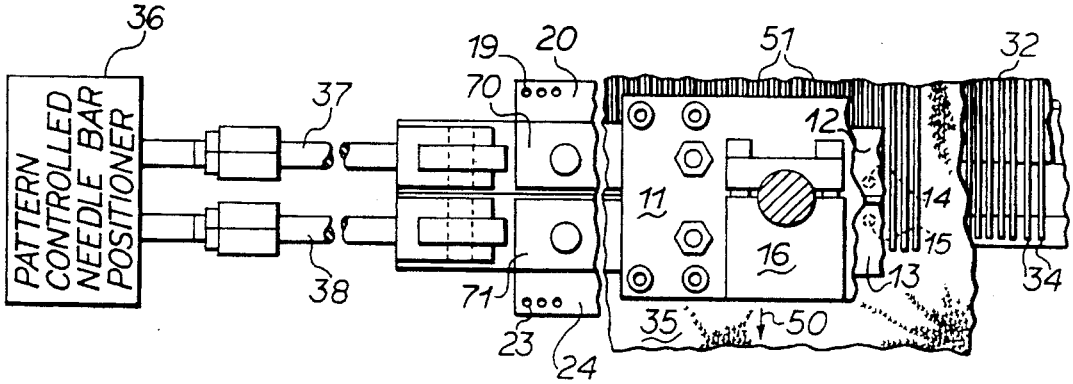
FIG. 2 is a fragmentary top plan view of the tufting machine of FIG. 1.

The front needle bar 12 and the rear needle bar 13 are shown slidably mounted in cooperation with front sliding rod 70 and rear sliding rod 71 which are mounted in linear ball bearing assemblies 72 to transversely or laterally shift the corresponding front needle bar 12 and rear needle bar 13. Each needle bar 12 and 13 may be transversely or laterally shifted independently of each other by appropriate pattern control means in a well known manner, such as the pattern controlled needle bar positioner mechanism 36 and corresponding push rods 37 and 38 (all shown in FIG. 2) connected to the respective front sliding rod 70 and rear sliding rod 71.

Again, referring to FIG. 1, supported upon a needle plate 32 and fixed to the bed frame 33 are a plurality of straight rearward projecting, transversely spaced, needle plate fingers 34 which project rearward between the vertical needle paths of the reciprocable front and rear needles 14 and 15. Supported for longitudinal rearward movement by conventional fabric feed mechanism or substrate drive (not shown) over the bottom needle plate 32 is the substrate or base fabric 35.

The needle drive mechanism, not shown, is designed to actuate push rods 16 to vertically reciprocate the pair of needle bars 12 and 13 to cause the front and rear needles 14 and 15 to simultaneously penetrate the substrate 35 far enough to carry the respective yarns 18 and 22 through the substrate 35 to form loops therein. After the loops are formed, the needles 14 and 15 are vertically withdrawn to their elevated retracted position disclosed in FIG. 1.

Figure 5:
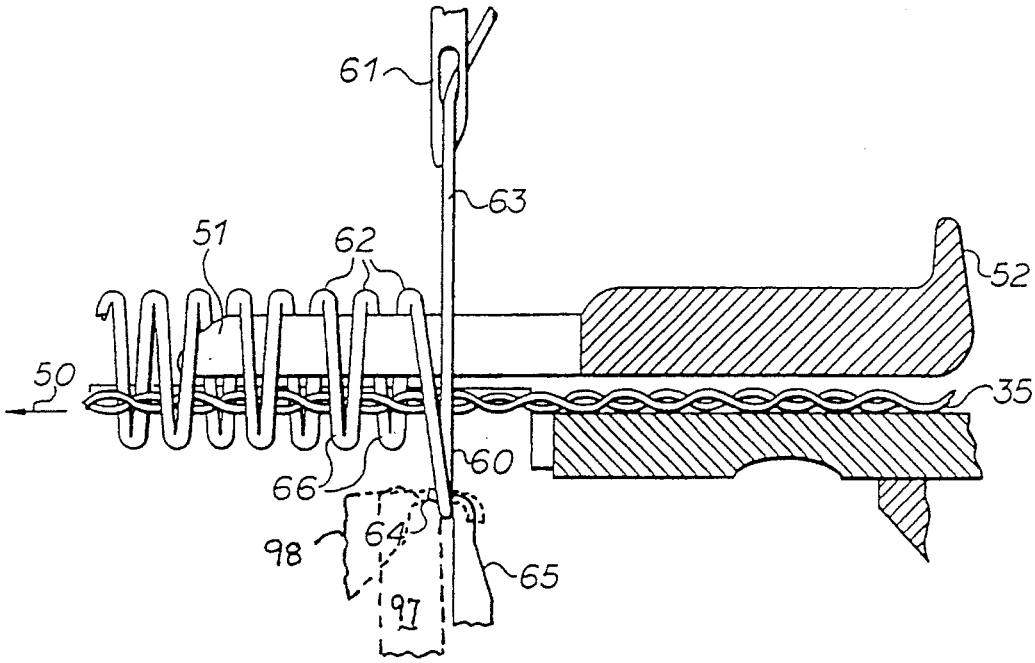
FIG. 5 is a fragmentary side view of a single needle bar tufting machine according to the present invention showing the formation of a single column of diagonally transverse loop stitches on the top of the substrate.

A looper apparatus 40 made in accordance with any of several such mechanisms, such as those disclosed in U.S. Pat. Nos. 4,800,828 and 3,973,505, includes a plurality of transversely spaced front loop pile hooks 41 and a plurality of transversely spaced rear loop pile hooks 42, there being at least one front loop pile hook 41 for each front needle 14 and at least one rear loop pile hook 42 for each rear needle 15. The front loop pile hooks 41 are so arranged that a bill 47 of a front hook 41 will cross and engage each front needle 14 when the front needle 14 is in its lower most position and in a well known manner to seize the yarn 18 and form a bottom pile loop 60 (as shown in FIG. 5) therein. The bills 47 of the front hooks 41 point rearward in the direction of fabric feed as indicated by the arrow 50

In a similar manner, the rear hooks 42 are so arranged that a bill 48 of a rear hook 42 will cross and engage each rear needle 15 when the rear needle 15 is in its lower most position and in a well known manner to seize the yarn 22 and form a bottom pile loop therein. The bills 48 of the rear loop pile hooks 42 point rearward in the same direction as the bills 47 of the front hooks 41 and the fabric feed 50.

The spacing or gauge of the hooks typically corresponds to the gauge of the needles. However, it is possible for the gauge of the hooks to be a multiple of the needle gauge in which case not every needle would be threaded with yarn so that there would still be a hook to cross and engage each threaded needle. It is also possible for the hook gauge to be a fraction of the needle gauge, or stated differently for the needle gauge to be a multiple of the hook gauge. In this case there are more hooks than needles.

In conventional tufting machine operation, the yarn feed pattern control mechanisms 21 and 25 would be programmed to back-rob certain front yarns 18 and rear yarns 22 in order to produce a desired high-low pile loop pattern. The yarns 18 and 22 can be selected from different colors or varying size or physical characteristics for the respective front and rear needles 14 and 15, or in some cases different yarns may be selected for various of the front needles 14 or for various of the rear needles 15. When it is desired to make even more complex patterns by shifting the needle bars 12 and 13, the pattern controlled needle bar positioning mechanism 36 is actuated in a well known manner. The machine 10 is then operated to produce the desired loop pile patterns in the substrate 35 as the substrate 35 moves in the direction of the arrow 50 rearwardly through the machine 10. In conventional operation, the patterns formed on the substrate 35 appear on the bottom surface 45 which faces the looper apparatus 40, while the upper surface 44 of the substrate 35 contains only the back stitching necessary to permit the needles 14 and 15 to move from one pile loop location to another.

A feature of the present invention is the addition of a loop forming plate 52 located forward of the needles 14 and 15 and above the substrate 35. Said loop forming plate 52 can be supported as illustrated by a member 55, descending from the head 26 of the tufting machine. On some tufting machines, the loop forming plate 52 can be inserted in place of an adjustable presser foot which is utilized to hold the substrate 35 proximate to the needle plate 32 when the needles are being vertically withdrawn to their elevated retracted position. Supported from the loop forming plate 52 are a plurality of straight rearward projecting, transversely spaced loop forming fingers 51 which project rearward between the vertical needle paths of the reciprocable rear and front needles 14 and 15. In most cases the spacing or gauge of the loop forming fingers 51 will correspond to the gauge of the hooks.

In operation, the front needles 14 and rear needles 15 are pushed through the substrate 35 to form pile loops on the bottom surface 45 in the conventional manner. Preferably these loops are made very low so that relatively little front yarn 18 or rear yarn 22 is on the bottom surface 45. When the front needles 14 and rear needles 15 are raised up through the substrate 35 and above the loop forming fingers 51 of the loop forming plate 52, the pattern controlled needle bar positioner 36 shown in FIG. 2 may be programmed to laterally displace the front needle bar 12 and corresponding front needles 14, or the rear needle bar 13 and corresponding rear needles 15, or both, from their previous positions. In typical carpet applications such lateral displacement is generally between one-tenth inch and one inch and is in units of distance equal to the spacing between the loop forming fingers 51 of the loop forming plate 52.

The yarn feed pattern control mechanisms 21 and 25 preferably provide the appropriate length of yarn for the length of lateral displacement of the needles. Then the needle drive mechanism again acts to force the push rods 16 downward, causing the front needles 14 and rear needles 15 to again penetrate the substrate 35. Pile loops are again formed on the bottom surface 45 in the conventional manner. As a result of the repetition of this action, the top surface 44 of the substrate 35 is covered with loop stitches that are transverse to the direction of the fabric feed 50. The direction of the fabric feed 50 imparts a slight diagonal to the stitches.

FIG. 5 shows a single needle 61 threaded with yarn 63 forming a column of diagonally transverse loop stitches 62 over a loop forming finger 51. The needle 61 penetrates the substrate 35 with the yarn 63. The yarn 63 is engaged by the bill 64 of a loop pile hook 65, thereby forming a yarn pile loop 60. The needle 61 is then raised above the substrate 35 and loop forming finger 51 and moved laterally across the loop forming finger 51, while the bill 64 is disengaged from the pile loop 60. The needle 61 is then lowered to again penetrate the substrate 35 which has been moved slightly through the tufting machine in the direction of the fabric feed 50, thereby forming a diagonally transverse loop stitch 62. In the process of raising and lowering the needle 61 some yarn is backrobbed from the pile loop 60 previously formed so that the resultant pile loop preferably has a low pile height as the pictured pile loops 66. If preferred for creating a double faced fabric or other purposes, a knife mechanism 97 (as shown in dashed line in FIG. 5) added, and typically the direction of the hooks 98 would be reversed, so that the pile loops 66 would be cut and the bottom surface would have a cut pile rather than loop pile surface. Also, if it is desired to make low loop stitches 62 on the face of the substrate, it is desirable to use loop forming fingers 51 that do not extend substantially rearward of the needles and will carry fewer stitches rather than the five stitches illustrated.

Figure 12A:
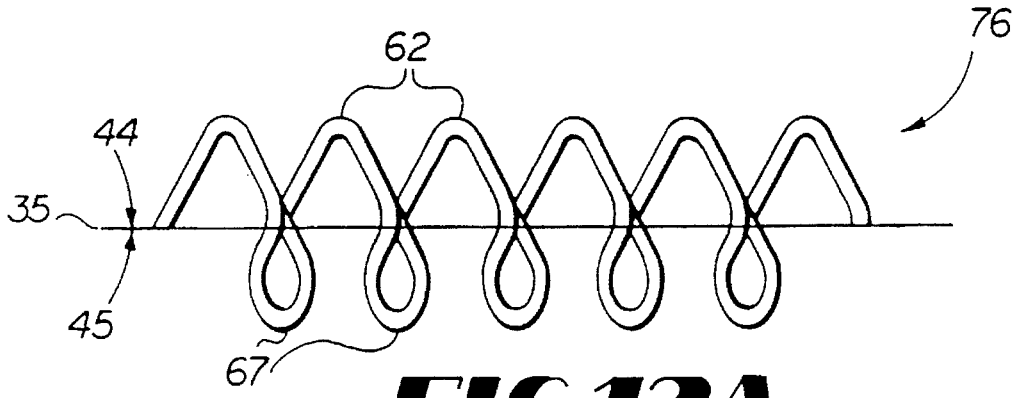
FIG. 12A is a sectional end view of a fabric formed according to the present invention.
Figure 12B:
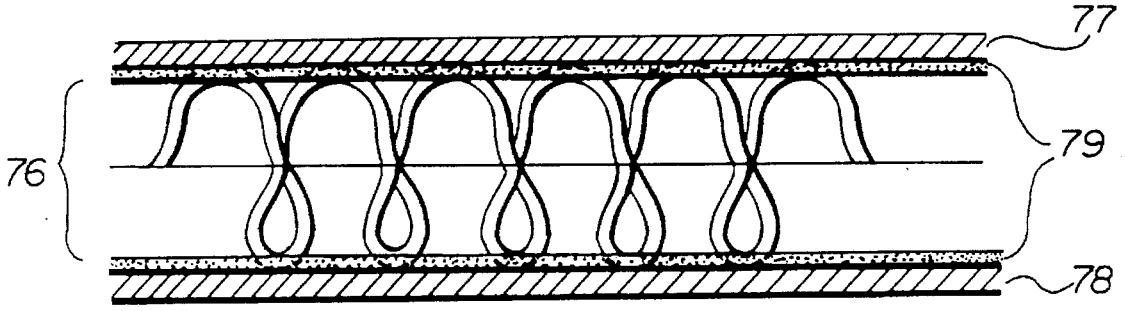
FIG. 12B shows the fabric of FIG. 12A sandwiched between two backing fabrics.
Figure 12C:
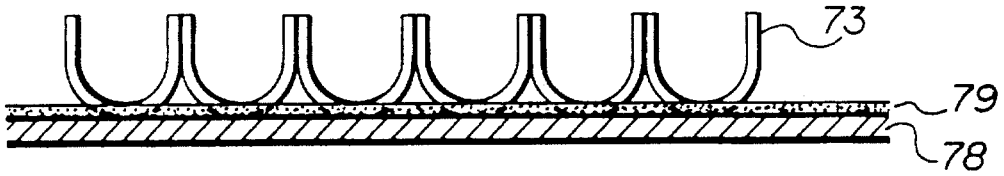
FIGS. 12C and 12D illustrate the fabrics formed when the sandwiched fabric of FIG. 12B is cut apart at its midpoint and the substrate is removed.
Figure 12D:
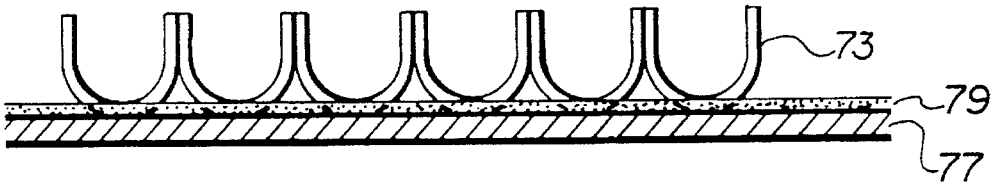

As shown in FIG. 12A, it is also possible to adjust the height and frequency of the loop stitches 62 on the face 44 of the substrate 35 to be nearly equal to the height and frequency of the pile loops 67 on the bottom 45 of the substrate 35 and thereby create a two-sided fabric 76. With such a two-sided fabric 76, the substrate 35 may be slightly offset from the center. Then as shown in FIG. 12B a first backing fabric 77 can be attached by latex or other suitable adhesive 79 to the top of the loop stitches 62 and a second backing fabric 78 can be similarly attached to the bottom of the pile loops 67, thereby sandwiching the two-sided fabric 76 between the first and second backing fabrics 77 and 78. The sandwiched two-sided fabric 76 is then sliced or cut apart approximately at the midpoint of the two-sided fabric 76 and the substrate is pulled away, leaving two separate fabrics of cut pile appearance consisting of a cut pile face yarn 73 and adhesive 79 on the surface of a backing fabric 77 and 78 shown in FIGS. 12C and 12D.

Figure 6:
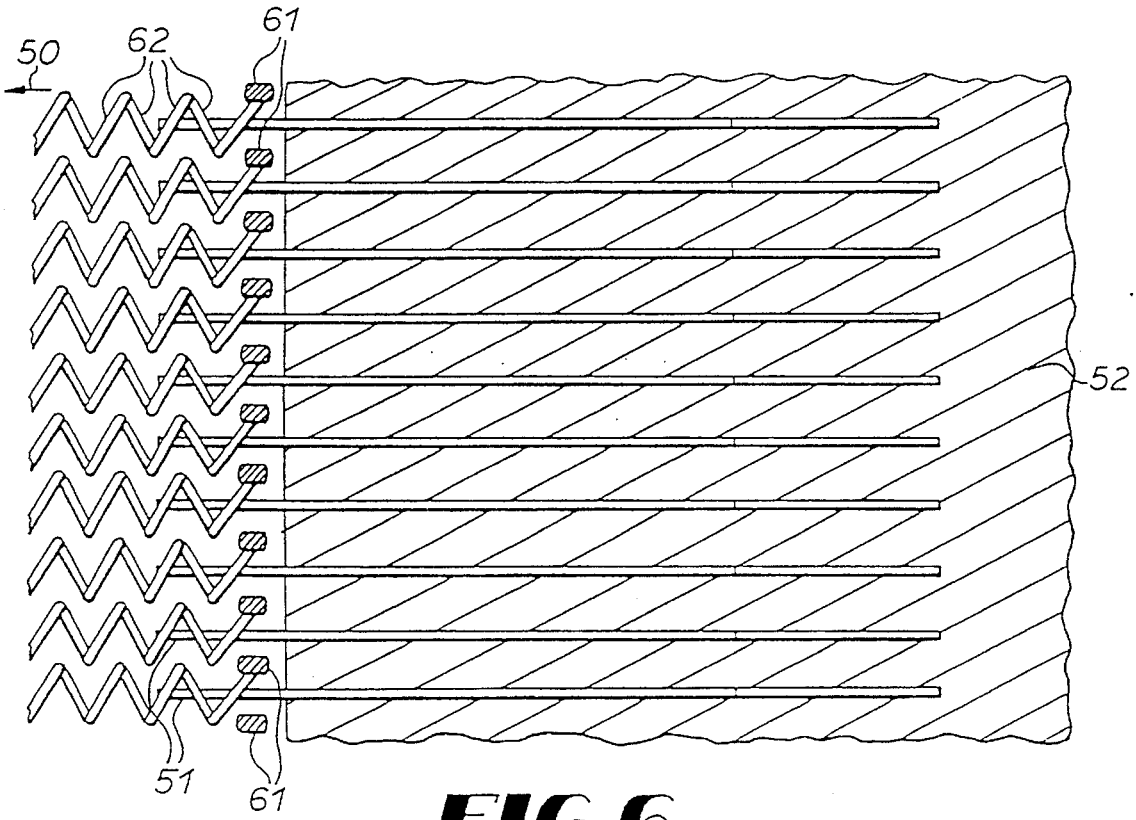
FIG. 6 is a fragmentary top plan view of a single needle bar tufting machine according to the present invention, forming columns of diagonally transverse loop stitches.

FIG. 6 illustrates a single row of needles 61 forming a fabric in the simple pattern shown. Each needle 61 has created a column of diagonally transverse loop stitches 62 over the loop forming fingers 51 of the loop forming plate 52.

Aside from the diagonally transverse loop stitch there are two additional types of stitches that can be formed by the present invention. A straight stitch can be formed by not laterally shifting the needle bar between stitches. In the case of a straight stitch, the yarn does not cross a loop forming finger 51 and is essentially similar to a back stitch formed on a conventional tufting machine. A transverse loop stitch or stitches may also be formed by stopping the fabric feed during the lateral displacement of the needles. Although this may be accomplished with cam driver mechanisms, it is desirable to have the fabric feed driven by at least one servo drive motor to allow for maximum flexibility.

Figure 11:
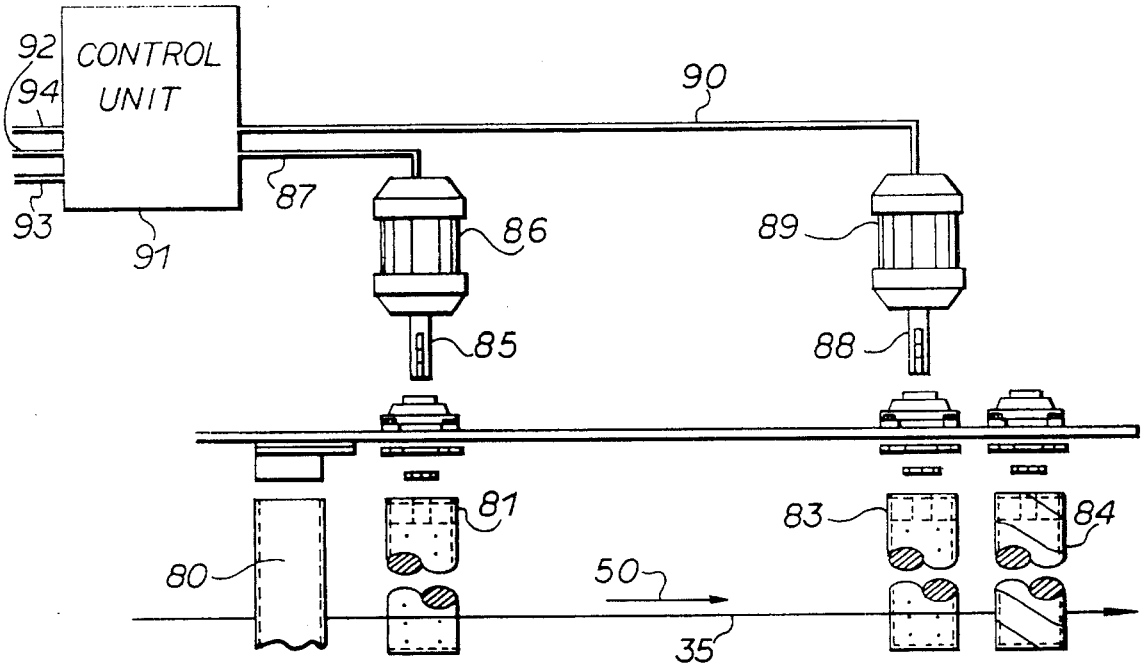
FIG. 11 is a diagrammatic illustration of the fabric feed mechanism of the present invention.

FIG. 11 shows in diagrammatic form one such fabric feed mechanism. Illustrated is the substrate 35 passing under the front cloth roller 80 and over the front spike roll 81, through the tufting and stitching area, over the rear spike roll 83 where the face of the loop stitched fabric may be viewed by the machine operator, and under the rear cloth roller 84. The front spike roll 81 and rear spike roll 83 are connected respectively by axles 85 and 88 to the front servo drive motor 86 and rear servo drive motor 89. The control unit 91 electrically signals the servo drive motors 86 and 89 via cables 87 and 90 to stop or advance the substrate. The control unit 91 is also in communication with the needle drive (not pictured) via cable 92, the pattern control yarn feed 21 and 25 (shown in FIG. 1) via cable 93, and the pattern controlled needle bar positioner 36 (shown in FIG. 2) via cable 94. In this fashion, the control unit 91 can synchronize the yarn feed, fabric feed, and needle bar positioner with the needle drive to create a programmed pattern.

Figure 4:
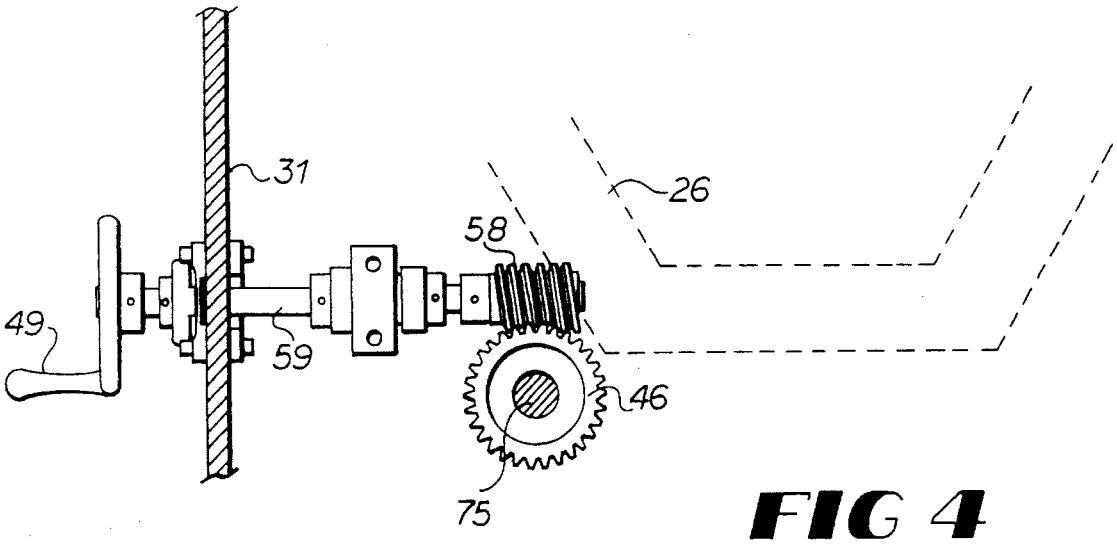
FIG. 4 is a side plan view of the crank adjustment for the loop forming plate shown in isolation.

Unlike the usual back stitches which are tightly stretched across the substrate 35, the transverse and diagonally transverse loop stitches formed by the present tufting machine apparatus are formed over the loop forming fingers 51 of the loop forming plate 52. In this fashion, raised yarn loops are formed on the top surface 44 of the substrate 35. The height of the loops on the top surface 44 can be varied by changing the loop forming plate 52 to another with higher or lower loop forming fingers 51, or by adjusting the positioning of the loop forming plate 52 so that the loop forming fingers 51 are elevated above the substrate 35. FIGS. 1 and 4 show a mechanism for adjusting the height of the loop forming fingers 51. In FIG. 4, a crank 49 is connected by shaft 59 to a worm 58 engaging a wheel gear 46. The wheel gear 46 is mounted on a shaft 75. As shown in FIG. 1, shaft 75 is also mounted with gear 57 which engages the teeth 56 of a rack face 54 coupled to member 55. Thus turning the crank 49 will cause the member 55 to be raised or lowered and will correspondingly raise or lower the loop forming plate 52 and loop forming fingers 51.

Figure 3:
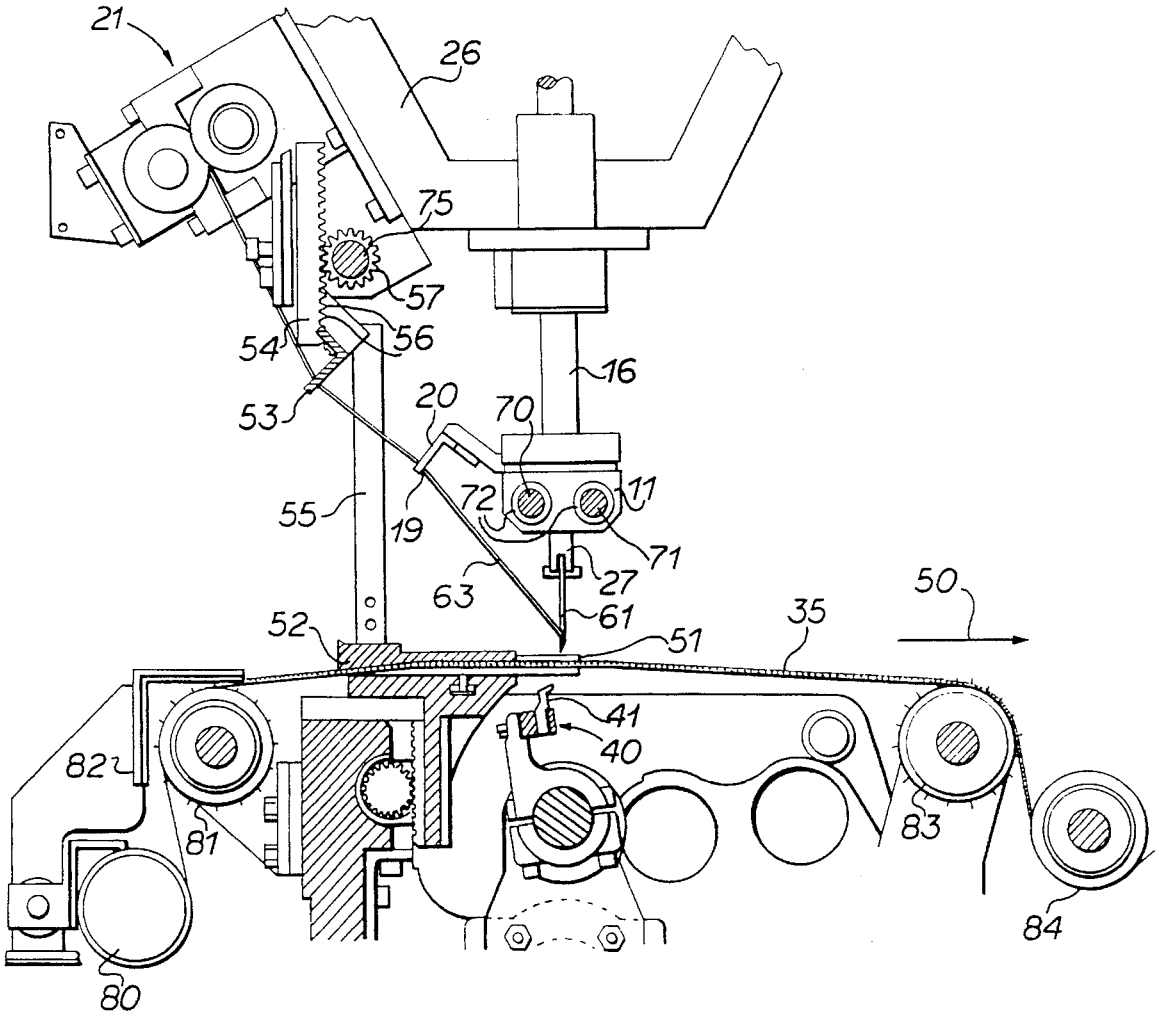
FIG. 3 is a sectional side view of a single needle bar tufting machine according to the present invention.

FIG. 3 shows a single needle bar adapted to the present invention. The single needle bar machine is in many respects similar to the multiple needle bar machine described in FIG. 1 with the following exceptions: only front yarns 63 are fed through a yarn feed pattern control device 21, though apertures 19 in the yarn guide plate 20 and through a row of transversely spaced needles 61. The needles 61 are mounted in a single needle bar 27 which is in turn connected to front sliding rod 70 and rear sliding rod 71 slideably mounted in linear ball bearing assemblies 72 in a plurality of transversely spaced needle bar carriers 11. As with the multiple needle bar machine of FIG. 1, the needle bar carriers 11 are each connected to a push rod 16 adapted to be vertically driven by a conventional needle drive mechanism. A pattern controlled needle bar positioner mechanism, not pictured, connected to the front and rear sliding rods 70 and 71 can transversely shift the front and rear sliding rods 70 and 71 and thereby transversely shift the needle bar 27 and needles 61.

Four representative and novel fabrics that can be created according to the invention are shown in FIGS. 7–10. These range from the simpler fabrics shown in FIGS. 7 and 8 that can be created on a tufting machine with a single needle bar, to a more complex fabric in FIG. 9 that is created by a tufting machine with two needle bars, and a complex single needle bar fabric in FIG. 10 utilizing the fabric feed and yarn feed controls, in addition to laterally shifting the needle bar, to vary the pattern.

Figure 7A:
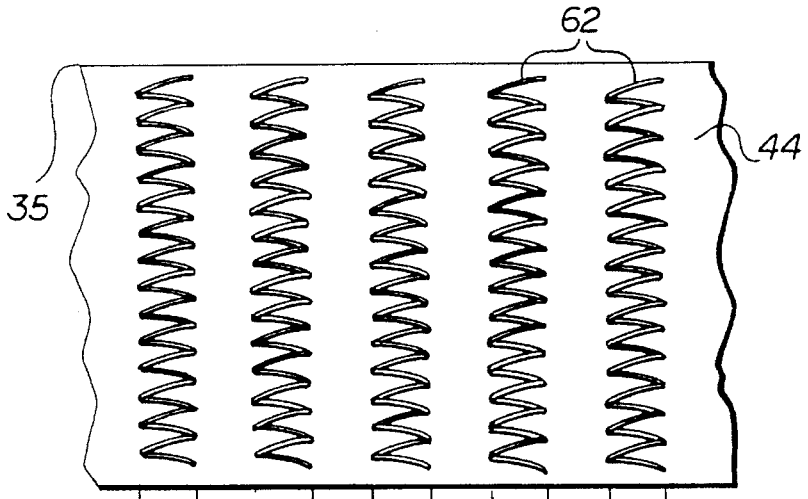
FIG. 7A is a top plan view of a fabric formed according to the invention.
Figure 7B:
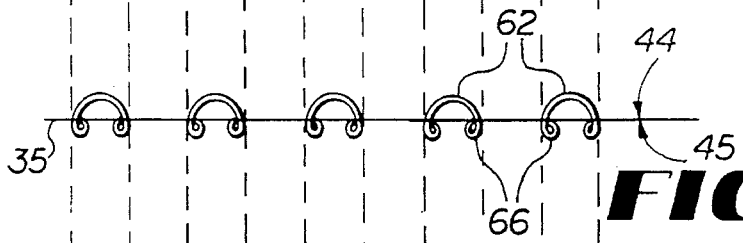
FIG. 7B is a sectional end view of the fabric pictured in FIG. 7A.
Figure 7C:
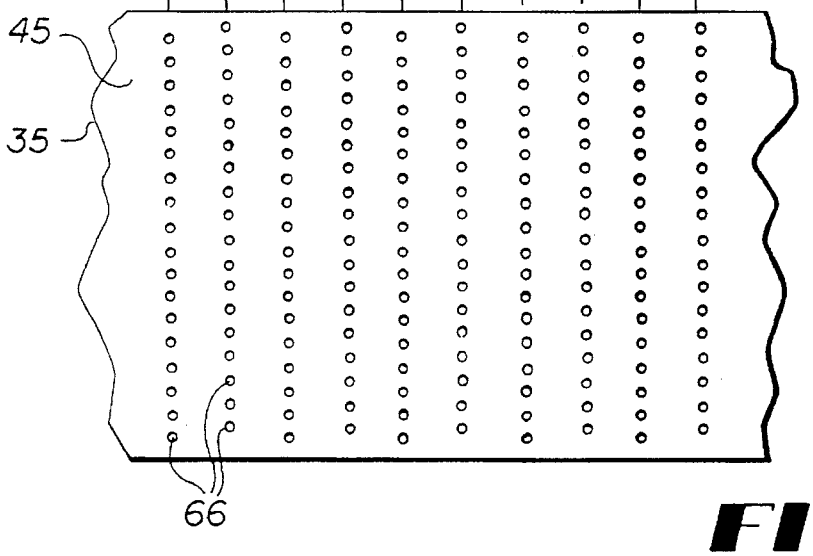
FIG. 7C is a bottom plan view of the fabric of 7A.

FIGS. 7A, 7B, and 7C show an example of a fabric that can be created by a tufting apparatus with the loop forming plate 52 and loop forming fingers 51. FIG. 7A shows the diagonally transverse loop stitches 62 formed on the top surface 44 of the substrate 35 by a simple lateral shift of the needles 61 over the adjacent loop forming finger 51. To create this fabric, threaded needles 61 (as shown in FIG. 5) are located between every second loop forming finger 51. FIG. 7B is an end view of one row of diagonally transverse loop stitches and low pile loops 66 formed by each needle 61. FIG. 7C shows the low pile loops 66 formed on the bottom surface 45 when the needles 61 penetrated the substrate 35.

Figures 8A, 8B, 8C:
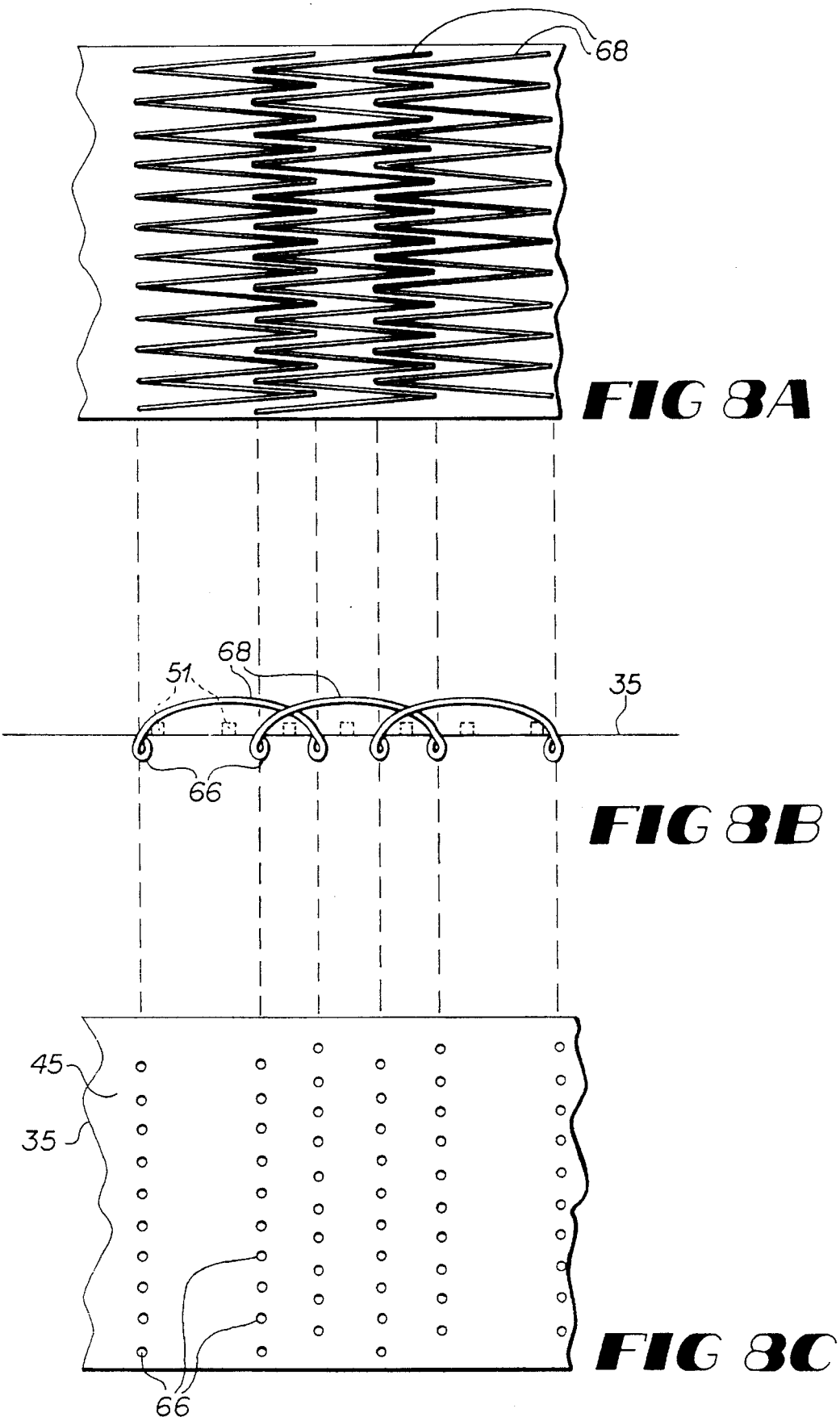
FIG. 8A is a top plan view of another fabric formed according to the invention.
FIG. 8B is a sectional end view of the fabric of 8A.
FIG. 8C is a bottom plan view of the fabric of 8A.

The simple pattern of FIG. 7 is presented primarily for illustrative purposes. This fabric may not be desirable for commercial manufacture, because the columns of diagonally transverse loop stitches 62 are not adjacent or overlapping, and the substrate 35 is visible between the columns. FIG. 8A, though, shows a different pattern created according to the present invention by a single row of needles 61. In the pattern shown in 8A, each needle 61 is laterally shifted over three loop forming fingers 51 shown in dotted outline, and a needle 61 is located between each pair of loop forming fingers 51. As shown in the end view of a row of stitches in FIG. 8B, the diagonally transverse loop stitches 68 formed are interlocking and produce a fabric with superior coverage over the substrate 35.

Figure 9A:
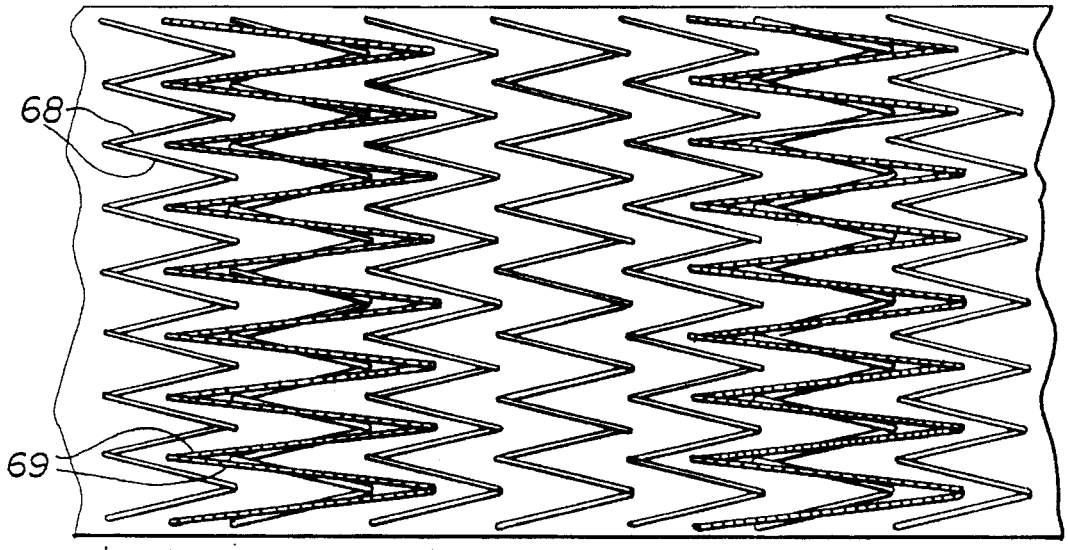
FIG. 9A is a top plan view of yet another fabric formed according to the invention.
Figure 9B:
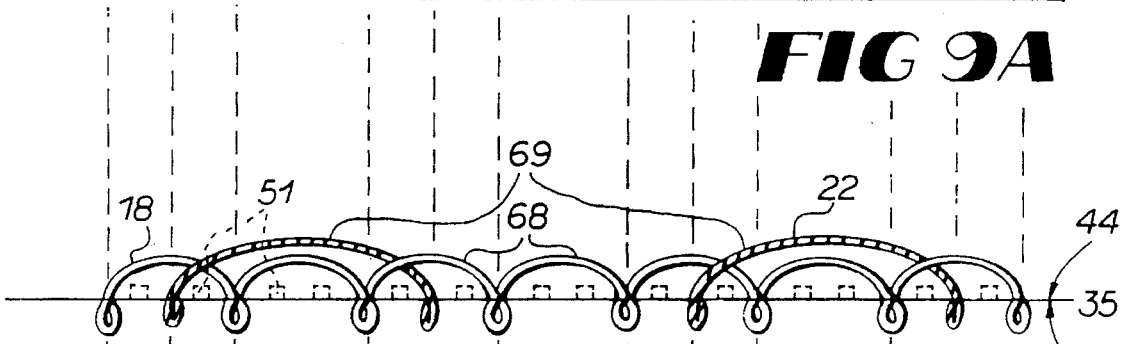
FIG. 9B is a section end view of the fabric of 9A.
Figure 9C:
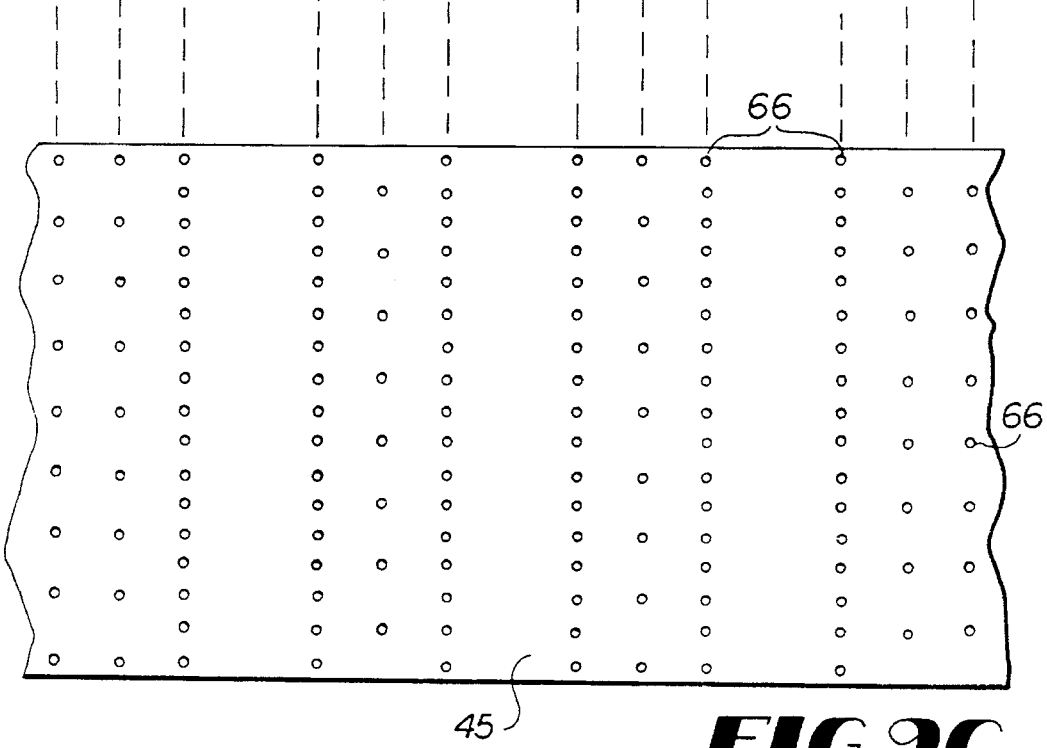
FIG. 9C is a bottom plan view of the fabric of 9A.

FIG. 9A shows a sectional view of a fabric tufted by a tufting machine with two independently shiftable needle bars, such as the machine illustrated in FIG. 1. In FIG. 9A, the striped yarn is the rear yarn 22 and the solid yarn is the front yarn 18. The front yarn 18 is threaded in every front needle 14. Front needles 14 are placed between every second loop forming finger 51 and are laterally shifted over two loop forming fingers 51 to form each front diagonally transverse loop stitch 68. The rear yarn 22 is threaded in every second rear needle 15. Rear needles 15 are placed between every second loop forming finger 51 and are offset from the front needles. For each rear diagonally transverse loop stitch 69, the rear needles 15 are laterally shifted over four loop forming fingers 51. Because the rear needles 15 sew on the substrate 35 after the front needles 14, the rear diagonally transverse loop stitches 69 partially cover the underlying front diagonally transverse loop stitches 68. Some columns of the front diagonally transverse loop stitches 68 are totally overlapped by the rear diagonally transverse loop stitches 69 while other columns are partially overlapped or not covered at all. FIG. 9B shows an end view of a single row of front and rear diagonally transverse loop stitches, 68 and 69.

Figure 10A:
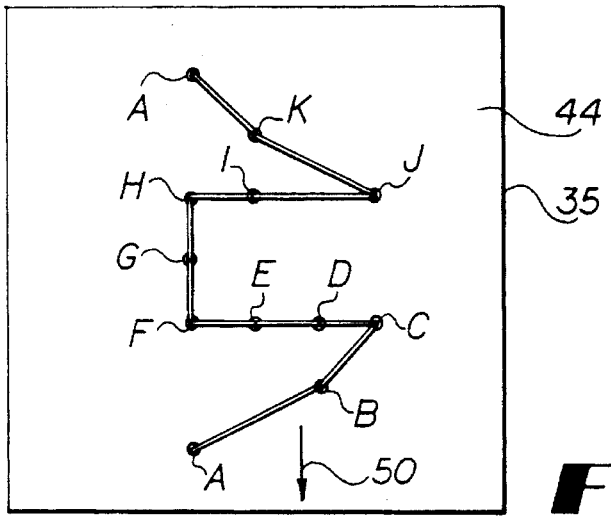
FIG. 10A is a top plan diagrammatic view of a series of loop stitches and straight stitches in a fabric formed by a single needle according to the invention.

FIG. 10A shows a series of 11 stitches made according to the present invention on a substrate 35. Beginning from the needle carrying yarn penetrating the substrate at position A, the needle is raised, the fabric feed advances the substrate 35 in the feed direction 50, the needle bar positioner moves the needle two gauge units to the right and the needle is lowered through the substrate 35 at position B. This creates the first diagonally transverse loop stitch A–B. The operation is repeated except the needle bar positioner moves the needle only one gauge unit to the right and the needle is lowered through the substrate 35 at position C to create a second diagonally transverse loop stitch B–C.

For the third stitch C–D, the needle is raised and moved one gauge unit to the left, the fabric feed is stopped, and the needle is lowered through the substrate 35 at position D. This creates a transverse loop stitch. The fourth stitch D–E, and fifth stitch E–F are transverse loop stitches made identically to the third stitch C–D.

For the sixth stitch F–G, the needle is raised but is not laterally shifted, the fabric feed advances the substrate 35 and the needle is lowered through the substrate 35 at position G to create a straight stitch. The seventh stitch G–H is another straight stitch made in the same fashion as the sixth F–G.

For the eighth stitch H–I, the needle is raised and moved one gauge unit to the right, the fabric feed is stopped, and the needle is lowered through the substrate 35 at position I to create a transverse loop stitch. The ninth stitch I–J is also a transverse loop stitch but the needle is moved two gauge units to the right.

The tenth stitch J–K is a diagonally transverse loop stitch with the needle being raised and moved two gauge units to the left with the fabric feed advancing the substrate 35, and then the needle is lowered at position K. The eleventh stitch K–A is another diagonally transverse loop stitch but the needle is moved only one gauge unit to the left.

Figure 10B:
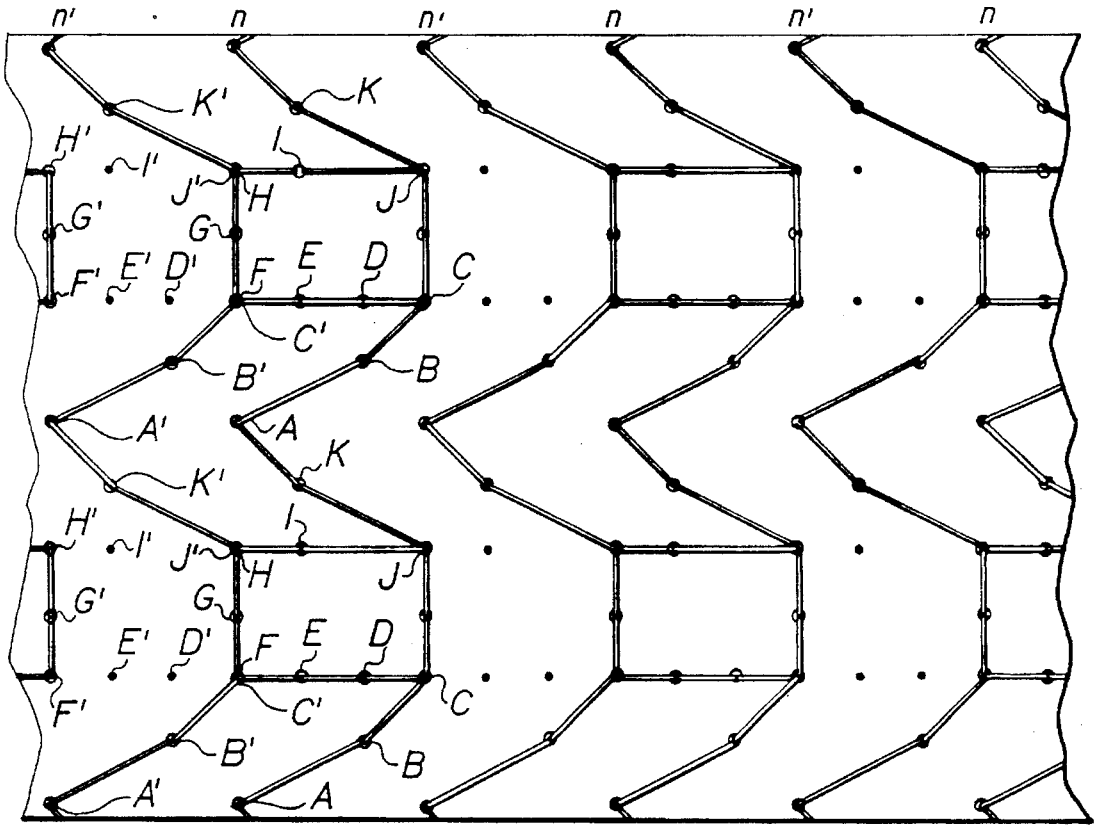
FIG. 10B is a top plan diagrammatic view of the fabric of 10A formed by a plurality of needles in which the yarn has been backrobbed from selected stitches and the resulting untufted yarn loops sheared from the fabric.

FIG. 10B shows the pattern made by a series of needles n executing two iterations of the pattern of FIG. 10A. The pattern made by needles n is complemented with the pattern made by needles n' which were alternatively spaced on the same needle bar. Because needles n and n' were on the same needle bar, those needles executed the same stitch pattern. However, in the case of needles n' on stitches C'–D', D'–E', E'–F', as well as stitches H'–I' and I'–J∝pattern control was directed not to allow sufficient yarn to the needles n' to form low pile loop stitches on the bottom of the substrate 35. Accordingly, when needles n' were raised up through the substrate 35, the backrobbing effect was sufficient to pull the yarn that penetrated the substrate 35 with needles n' back up to the face 44 of the substrate 35. Accordingly, stitches C'–D', D'–E' and E'–F' were not anchored by tufts penetrating the substrate 35 at either position D' or E', while stitches H'–I' and I'–J' were not anchored by a tuft penetrating the substrate 35 at position I'. Then the tufted fabric was processed by a shearing machine of conventional design and the loose untufted yarn from C' to F' and from H' to J' was cut away leaving the fabric as illustrated.

The stitching method described in connection with FIGS. 10A and 10B can be used both in the manufacture of fabrics directly on a plain substrate and for ornamental overtufting of existing fabrics.

Numerous advantages are inherent in the tufted fabrics illustrated in FIGS. 7 though 10. The transverse and diagonally transverse loop stitches give better coverage of substrate for a given weight of face yarn. Also, the substantially transverse orientation of the loop stitches prevents "grinning" or the exposure of the underlying substrate when the fabric is creased, as when a carpet is pulled over the edge of stair treads or the like. The resulting fabrics also have less resistance to a sliding traffic and higher abrasion resistance than conventional tufted fabrics. Fabrics made according to the present invention also have more drape or a greater tendency to lie flat, but are still easy to roll up due to the transverse or diagonally transverse alignment of a substantial number of stitches.

Numerous alterations of the structures and methods herein described will suggest themselves to those skilled in the art. It will be understood that the details and arrangements of the parts and yarns that have been described and illustrated in order to explain the nature of the invention are not to be construed as any limitation of the invention. All such alterations which do not depart from the spirit of the invention are intended to be included within the scope of the appended claims.

What is claimed is:

1. A tufting machine comprising:

(a) means for supporting a substrate for longitudinal movement in a feeding direction from front-to-rear through the tufting machine;

(b) a front needle bar having a plurality of front needles spaced transversely of said feeding direction;

(c) a rear needle bar behind said front needle bar in said feeding direction and having a plurality of rear needles spaced transversely of said feeding direction;

(d) a needle drive means for reciprocally moving said needle bars toward and away from the substrate and thereby causing said front needles and said rear needles to move in substantially vertical needle paths and to stitch yarns through the substrate; and (e) a pattern control actuator means operatively connected to said front and rear needle bars to shift said needle bars independently of each other in predetermined increments transversely of said feeding direction; and (f) a loop forming plate fixably supported above the substrate having a plurality of transversely spaced loop forming fingers projecting rearwardly between the vertical needle paths of the front and rear needles.

2. The invention according to claim 1 further comprising a mechanism for adjusting the height of said loop forming plate.

3. The invention according to claim 1 further comprising a substrate drive.

4. The invention according to claim 1 further comprising a yarn feed pattern control mechanism.

5. The invention according to claim 1, further comprising a looper mechanism located beneath the substrate that is moving through the machine, including reciprocally mounted first and second hooks, means for actuating said hooks in timed relation with said needle drive means so that said first hooks cooperate with said front needles and said second hooks cooperate with said rear needles to form first and second yarn pile loops in the substrate.

6. The invention according to claim 5, further comprising a knife cooperating with at least one of said hooks, and means for actuating said knife in timed relationship with said hook to form cut pile tufts.

7. The invention according to claim 5 in which said hooks have a normal predetermined hook gauge, the spacing of front and rear needles being equal to a multiple of said hook gauge, and said pattern-controlled actuator means being programmed to shift at least one of said needle bars a transverse increment equal to a multiple of said hook gauge for a stitching cycle.

8. The invention according to claim 5 in which said hooks have a normal predetermined hook gauge, the spacing of the front needles being equal to a fraction of said hook gauge and thereby constituting a front needle gauge, said pattern control actuator means being programmed to shift the front needle bar a transverse increment equal to a multiple of said front needle gauge for a stitching cycle.

9. The invention according to claim 5 in which said hooks have a normal predetermined hook gauge, the spacing of the rear needles being equal to a fraction of said hook gauge and thereby constituting a rear needle gauge, said pattern control actuator means being programmed to shift the rear needle bar a transverse increment equal to a multiiple of said rear needle gauge for a stitching cycle.

10. A tufting machine comprising:

(a) means for supporting a substrate for longitudinal movement in a feeding direction from front-to-rear through the tufting machine;

(b) a needle bar having a plurality of needles spaced transversely of said feeding direction;

(c) a needle drive means for reciprocally moving said needle bar toward and away from the substrate thereby causing said needles to move in substantially vertical needle paths and to stitch yarns through the substrate;

(d) a pattern control actuator means operatively connected to said needle bar to shift said needle bar in predetermined increments transversely of said feeding direction; and (e) a loop forming plate fixably supported above the substrate having a plurality of transversely spaced loop forming fingers projecting rearwardly between the vertical needle paths of the needles.

11. The invention according to claim 10 further comprising a mechanism for adjusting the height of said loop forming plate.

12. The invention according to claim 10 further comprising a substrate drive.

13. The invention according to claim 10 further comprising a yarn feed pattern control mechanism.

14. The invention according to claim 10, further comprising a looper mechanism located beneath the substrate that is moving through the machine, including reciprocally mounted hooks, means for actuating said hooks in timed relation with said needle drive means so that said hooks cooperate with said needles and to form yarn pile loops in the substrate.

15. The invention according to claim 14, further comprising a knife cooperating with at least one of said hooks, and means for actuating said knife in timed relationship with said hook to form cut pile tufts.

16. The invention according to claim 14 in which said hooks have a normal predetermined hook gauge, the spacing of said needles being equal to a multiple of said hook gauge, said pattern controlled actuator means being programmed to shift the needle bar a transverse increment equal to a multiple of said hook gauge for a stitching cycle.

17. The invention according to claim 14 in which said hooks have a normal predetermined hook gauge, the spacing of said needles being equal to a fraction of said hook gauge and thereby constituting a needle gauge, said pattern control actuator means being programmed to shift the needle bar a transverse increment equal to a multiple of said needle gauge for a stitching cycle.

* * * * *